US005936351A

United States Patent [19]

Lang

[11] Patent Number: 5,936,351

[45] Date of Patent: Aug. 10, 1999

[54] CERAMIC DISCHARGE VESSEL

[75] Inventor: Dieter Lang, Bruckmuehl, Germany

[73] Assignee: Osram Sylvania Inc., Danvers, Mass.

[21] Appl. No.: 08/949,523

[22] Filed: Oct. 14, 1997

[51] Int. Cl.[6] ..... H01J 17/16; H01J 61/30; H01J 63/04; H01J 1/62

[52] U.S. Cl. ..... 313/634; 313/570; 313/571

[58] Field of Search ..... 313/491–93, 605–6, 313/620–27, 631–32, 634–636, 573–74, 570, 571

[56] References Cited

U.S. PATENT DOCUMENTS

| | | | |
|---|---|---|---|
| 3,885,181 | 5/1975 | Nelson et al. | 313/364 |
| 4,161,672 | 7/1979 | Cap et al. | 313/620 |
| 4,468,590 | 8/1984 | Akutsu et al. | 313/634 X |
| 4,643,690 | 2/1987 | Caruso et al. | 445/6 |
| 5,138,228 | 8/1992 | Thomas et al. | 313/634 |
| 5,239,230 | 8/1993 | Mathews et al. | 313/620 X |
| 5,416,383 | 5/1995 | Genz | 313/634 |
| 5,486,737 | 1/1996 | Hrubowchak et al. | 313/634 |
| 5,497,049 | 3/1996 | Fischer | 313/634 |

FOREIGN PATENT DOCUMENTS

| | | |
|---|---|---|
| 0128551 | 12/1984 | European Pat. Off. . |
| 0156385 | 10/1985 | European Pat. Off. . |
| 0290043 | 11/1988 | European Pat. Off. . |
| 2079181 | 5/1997 | Russian Federation . |
| 2085650 | 4/1982 | United Kingdom . |

*Primary Examiner*—Sandra O'Shea
*Assistant Examiner*—Mack Haynes
*Attorney, Agent, or Firm*—William H. McNeill

[57] ABSTRACT

A ceramic discharge vessel for a high-pressure discharge lamp is formed of a cylindrical central part and two hemispherical end pieces, whereby the length of the central part is smaller than or equal to the radius of the end pieces. In this way, the isothermy of the discharge vessel is improved.

10 Claims, 1 Drawing Sheet

CERAMIC DISCHARGE VESSEL

TECHNICAL FIELD

This invention relates to discharge vessels and more particularly to such vesssels for use as the arc chambers in arc discharge lamps.

Still more particularly it relates to ceramic discharge vessels for metal halide lamps or sodium high-pressure lamps. The discharge vessel usually comprises aluminum oxide, which can be provided with doping substances. However, other known materials can also be used, such as sapphire, aluminum nitride, etc.

BACKGROUND ART

It is known in the art to shape the discharge vessel as a longitudinally extending cylinder or as a vessel that bulges out in the center for sodium high-pressure discharge lamps, whereby the inner diameter of the discharge volume is greater than that at the ends. It is particularly taught that the inner diameter at the level of the electrode tip amounts to at least 60% of the inner diameter in the center.

A discharge vessel also is known which is shaped from a straight cylindrical tube, which possesses ends with reduced diameter. The cylindrical tube can have an elliptical cross section. Alternatively, a very longitudinally extended elliptical discharge vessel also is known, whereby the axis ratio amounts to 1:4 to 1:8.

In the case of such longitudinally extended discharge vessels, a universal burning position is not possible when the filling contains metal halides. In the vertical burning position, the cold-spot temperature, which is found in the region of the lower electrode, is clearly lower than for the horizontally burning lamp. As a consequence, there is a pronounced color shift between horizontal and vertical burning positions. Further, the temperature distribution is relatively inhomogeneous in the case of such longitudinally extended geometries of the discharge vessel, so that a more intense temperature gradient occurs. In the case of a preselected cold-spot temperature (which is necessary for achieving the aimed-at light-technical values), a very high hot-spot temperature is established in the case of longitudinally extended geometry, which can lead to an overloading of the ceramics of the discharge vessel.

A cylindrical discharge vessel with end surfaces applied at right angles is known, in which the electrodes are inserted in a recessed position in the ends. Such cylindrical discharge vessels in fact permit a universal burning position, but their temperature distribution is also inhomogeneous, so that here also, a very high hot-spot temperature arises.

A high temperature gradient, as is formed both in longitudinally extended elliptical as well as cylindrical discharge vessels, favors corrosion phenomena on the ceramics during the service life of the lamp.

In addition, the principal possibility given by the use of ceramics, to increase the cold-spot temperature in comparison to quartz glass and thus to improve the light-technical data, is limited in these geometries by the very high hot-spot temperature that occurs therein. The hot-spot temperature of the ceramics is limited maximally to approximately 1250° C., if service lives of 6,000 to 10,000 hours are aimed at.

It has also resulted from this that in the case of such longitudinally extended cylindrical or elliptical discharge vessels, the light-technical and electrical lamp data are greatly dependent on burning position, due to their very inhomogeneous temperature distribution. Such discharge vessels can thus only be applied, if it is not required that these lamp data be independent of burning position. This is only possible for lamps with a base on both sides. Normally, only a horizontal burning position is possible for them.

DISCLOSURE OF INVENTION

It is, therefore, an object of the invention to obviate the disadvantages of the prior art.

Yet another object of the invention is the enhancement of arc discharge lamps.

These objects are accomplished, in one aspect of the invention, by the provision of a ceramic discharge vessel for a high-pressure discharge lamp having an arc chamber defined by an inner volume which contains a light-emitting filling, and which has a longitudinal axis as well as two ends with openings, whereby electrical leads are introduced in a gas-tight manner into the openings, which leads are connected electrically with two electrodes, which stand opposite each other in the inner volume at a given electrode distance. The vessel is further characterized in that the contour of the inner wall has the following geometry: the contour has an essentially straight cylindrical central part of length L and inner radius R as well as two essentially hemispherical end pieces with the same radius R, the length of the cylindrical central part being smaller than or equal to its inner radius: the inner length of the discharge vessel is at least 10% greater than the electrode distance; the diameter (2R) of the discharge vessel corresponds to at least 80% of the electrode distance; at the same time, it should have at most a dimension of 150% of the electrode distance.

BEST MODE FOR CARRYING OUT THE INVENTION

Figure 1:
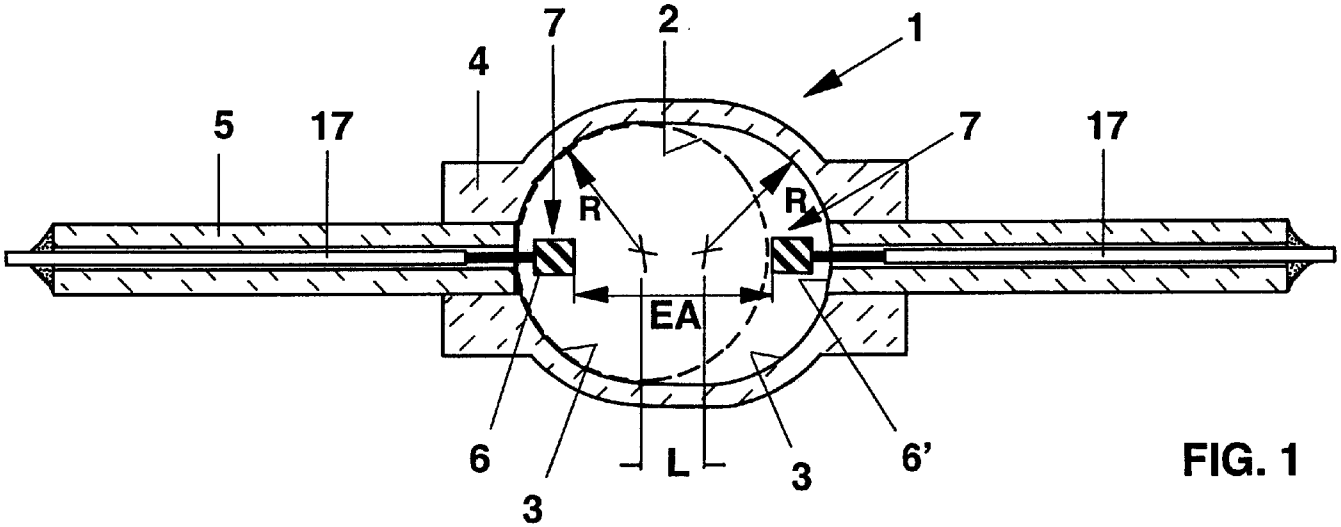
FIG. 1 is an elevational, sectional view of a ceramic discharge vessel of a metal halide lamp.

For a better understanding of the present invention, together with other and further objects, advantages and capabilities thereof, reference is made to the following disclosure and appended claims taken in conjunction with the above-described drawings.

The present invention describes a special "belly" geometry of the discharge vessel, which leads to approximately equivalent photometric lamp data for any burning position, in contrast to known discharge vessels with longitudinally extended cylindrical or elliptical geometry. This geometry leads particularly to a reduced hot-spot temperature and to a very uniform temperature distribution.

Specifically, this involves a ceramic discharge vessel in the case of the present invention for a high-pressure discharge lamp, which contains a light-emitting filling. The contour of the inner wall of the discharge vessel defines an inner volume V. The discharge vessel has a longitudinal axis as well as two ends with openings, whereby electrical leads are introduced in a gas-tight manner, which leads are electrically connected to two electrodes, which stand opposite each other in the inside volume at a given electrode distance EA.

The inner contour of the discharge vessel can be considered as composed of three parts, i.e., an essentially straight cylindrical central part with length L and with inner radius R as well as two essentially hemispherical end pieces with the same radius R connecting to the central part on both sides.

It has been shown that a sufficient independence of burning position is assured by simultaneously maintaining several geometric limiting conditions.

The basic condition is that the length of the cylindrical central part is smaller than or equal to its inner radius. This condition can be expressed thusly, $L \leqq R$.

In a preferred embodiment, the inner diameter of the discharge vessel must amount to at least ⅔ of the total length of the discharge vessel, and the condition $L \leqq 0.8\ R$ is particularly preferred.

L and R are selected such that specific limiting conditions are maintained for the electrode distance EA. These define an upper and lower limit for the insertion length of the electrodes in the inner volume.

The total inner length of the discharge vessel must be at least 10% longer than the electrode distance EA. Otherwise, the electrodes come too close to the end region and too greatly heat the feed-through region of the conductive leads. This condition can be expressed as $2R+L \geqq 1.1EA$.

The diameter (2R) of the discharge vessel must have at least a dimension of 80% of the electrode distance EA; otherwise, the discharge vessel will heat unnecessarily too greatly in the center due to the curvature of the arc. At the same time, the diameter should have at most a dimension of 150% of the electrode distance EA, since otherwise the central part would remain too cold. Expressed mathematically this latter condition is $1.5\ EA \geqq 2R \geqq 0.8\ EA$ Overall, a ratio between the total length and the maximum inner diameter of at most 1.5, and preferably smaller than or equal to 1.3 results from the measurements for the discharge vessel.

The wall load of the discharge vessel (i.e., the rated power referred to the inner surface) can preferably be adjusted to values between 25 and 45 W/cm$^2$, prefereably between 25 and 35 W/cm$^2$ with this geometry, and, in fact, in the case of lamps of small wattage, particularly around 35 W/cm$^2$, (in the case of 20 W rated wattage even up to 45 W/cm$^2$)and in the case of high-watt lamps, preferably 25 W/cm$^2$. This is particularly true in the range of approximately 20 W up to approximately 250 W lamp power. Thus, the wall load is approximately 10% smaller than in the case of conventional lamps according to the above-cited state of the art.

In a particularly preferred form of embodiment, the wall load of the discharge vessel (in W/cm$^2$) is selected for a rated voltage between 35 and 250 W as a function of the rated power P (in W) and the magnitudes R and L (each in cm) of the discharge vessel, such that $25 \leqq P/(4\pi R^2+2\pi RL) \leqq 35$.

Volume V of the discharge vessel lies at approximately 100–150 $\mu$l for a 35 W lamp, and increases by approximately 7–10 $\mu$l per watt of additional rated power. The converse is true for a smaller power. A 20 W lamp has a volume V of approximately 35 $\mu$l.

In a particularly preferred embodiment, the inside volume V of the discharge vessel (in $\mu$l) is selected dependent on rated power P (in W) according to the following formula: $0.16 \bullet P^{5/3} \leqq V \leqq 0.32 \bullet P^{5/3}$, preferably $0.22 \bullet P^{5/3} \leqq V \leqq 0.32 \bullet P^{5/3}$.

In order to obtain a temperature distribution that is as homogeneous as possible, it has also been found advantageous, if L is selected $\leqq 0.6$ R. This is particularly of importance for low-watt lamps, in which heat losses at the ends, viewed relatively, are the highest. In this case, the inner contour can be described in good approximation by a rotation ellipsoid with the semiminor axis a and the semimajor axis b, whereby $R \leqq a \leqq 1.1\ R$ and $b=R+L/2$.

Advantageously, the wall thickness of the discharge vessel amounts to between 5 and 15% of the inner radius R at least in the center of the discharge vessel. A discharge vessel is particularly suitable, in which the wall thickness increases toward the ends and at the ends amounts to double the wall thickness in the center.

Normally, the discharge vessel comprises aluminum oxide, which may be doped with magnesium oxide and other oxides, or also may comprise other materials such as aluminum nitride or sapphire.

The present invention also refers particularly to a high-pressure discharge lamp with a ceramic discharge vessel as described above.

At the ends of the discharge vessel, preferably separate ceramic plugs are introduced (possibly also designed as cermet) for taking up the current leads. However, the ends may also be integral components of the discharge vessel. The leads can be selected from a number of forms known in and of themselves (e.g., a tube or pin of niobium or molybdenum or a conducting cermet), and are particularly designed as capillaries, in which is soldered a suitable electrode system.

The inner contour of the discharge vessel is essentially described herein. The outer contour, which is of less importance for the present invention, is then predetermined more or less by the wall thickness.

In the simplest case, the outer contour is given bythe inner contour because of a uniform wall thickness. The wall thickness amounts to between 5% and 15% of the inner radius of the discharge vessel. However, it is more appropriate to have slightly increasing wall thicknesses from the center to the ends. This operates first as a measure for heat build-up and also increasingly conducts heat from the center to the ends, which partially compensates for heat losses due to the electrode system and the feed-through region. Thus, a further homogenizing of the temperature distribution is produced. The wall thickness increases in this case from typically 10% of the inner radius in the center of the discharge vessel up to double this value in the end region. This also prevents a rapid corrosion of the ceramics during the service life, which occurs earliest in the end region.

Referring now to the drawings with greater particularity, the ceramic discharge vessel 1 shown in FIG. 1 is designed for a 70-W lamp. It comprises a cylindrical straight central part 2 with length L=2 mm and two hemispherical end pieces 3 with radius R=4 mm. The total length of the inner volume is 10 mm. The wall thickness of the discharge vessel is a constant 0.9 mm. The maximum outer diameter is 9.8 mm. Cylindrical, integral, approximately 1.5 mm long connection pieces 4 extend axially outwardly on each end piece 3. Ceramic longitudinal plugs 5 are inserted into these. They are inserted somewhat recessed in connection pieces 4, so that they better approximate the ideal form of the semicircular inner contour. In the simplest case, they have inner front sides 6, which are straight (FIG. 1, left half). The inner front surface 6' of the plug is advantageously beveled or even arched concavely and is thus even better adapted to the semicircular inner contour (FIG. 1, right half). In this way, an ideal isothermy is produced.

An electrode system, comprising an electrode 7 and a feed-through or current lead 17, is inserted into each of the plugs, this system being analogous to that described in EP-A 587,238, whereby the electrode distance amounts to 7.5 mm. The filling contained in the discharge volume contains a mixture of metal halides NaI and TlI with rare-earth iodides, such as, e.g., $DyI_3$, $TmI_3$ and $HoI_3$, as are commonly used for lamps with a high wall load. Thus, an initial color temperature of 3030±80 K is obtained in the vertical burning position and 2980±80 K in the horizontal burning position. The temperature difference between the cold spot and the hot spot amounts to only 20° in this lamp, compared to 70° in conventional cylindrical lamps with end surfaces placed at a right angle.

The wall load of this discharge vessel amounts to approximately 28 W/cm$^2$. The inner volume of the discharge vessel is 370 $\mu$l.

Figure 2:
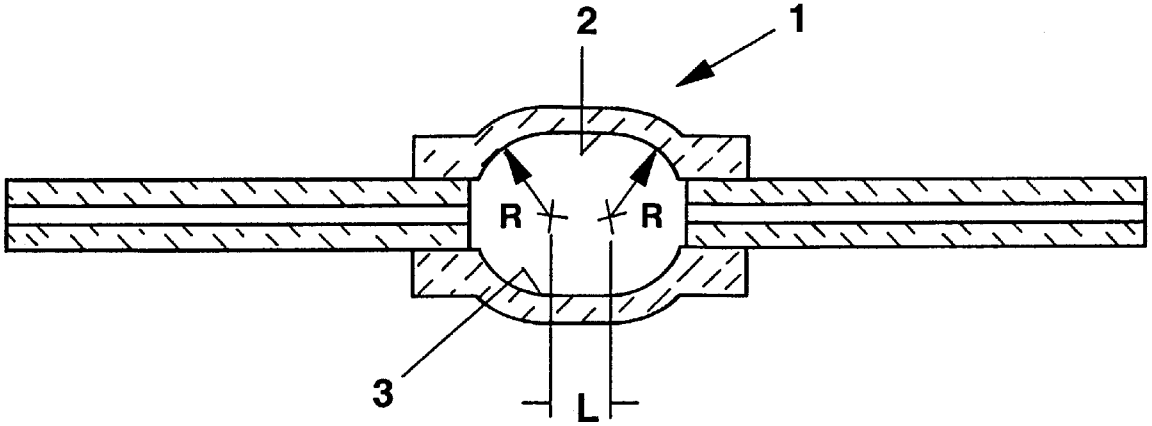
FIG. 2 is an elevational, sectional view of an alternate embodiment of a ceramic discharge vessel.

A discharge vessel 1 for a 35-W lamp is shown in FIG. 2. Here, the length of the cylindrical central part 2 is 1.9 mm, whereas the radius of the hemispherical end piece 3 now amounts to 2.55 mm. The total length of the inner volume is 7.0 mm.

The wall thickness of discharge vessel 1 increases from the center (0.8 mm) outwardly to a maximum of 0.95 mm. The maximum outer diameter is 6.8 mm. Integral connection pieces 4 and separate plugs 5 are again provided here.

In other similarly constructed examples, the lamp power is selected higher. With a 100-W power, L=2.5 mm and R=4.5 mm. With a 150-W power, L=2 mm and R=6 mm. With 250-W power, L=6 mm and R=7.0 mm.

In order to satisfactorily fulfill the requirements, for which the above-presented contour is sufficient, an approximate maintaining of the above-given dimension specifications with a maximum 15% deviation is also sufficient.

Thus for the limiting case of small lengths of the central part (L≈0.5 R) the description of the inner contour by means of an elliptical 5%.

Assuming that the semiminor axis a of the ellipse is selected such that the deviation from the ideal contour (with radius R and length L of the central part) is at most 15%, then R≦a≦1.1 R, and taking into consideration the fact that the semimajor axis b can be presented as b=R+L/2, a comparison of the two contours is shown. A ratio for the semi-axes of the ellipsoid of b/a≦1.25 results.

The remaining rules of dimensioning with respect to electrode distance and wall load are thus further valid in an unchanged manner.

The example of a 70-W lamp has an inner contour 10 of discharge vessel is shaped as a closed ellipsoid with dimensions of a=4.4 mm and b=5 mm, proceeding from a design with R=4 mm. Thus, b/a=1.14. End pieces are produced together with plugs integrally from a single ceramic mold part, which is comprised of aluminum oxide. The wall thickness continually increases from the center, where it amounts to 0.8 mm, to double this value at the ends.

All such lamps also show no corrosion of the discharge vessel after 9000 hours. In contrast, the best conventional lamps according to the initially given state of the art have a failure rate of 50% after 8000 hours.

While there have been shown and described what are at present considered to be the preferred embodiments of the invention, it will be apparent to those skilled in the art that various changes and modification can be made herein without departing from the scope of the invention as defined by the appended claims.

What is claimed is:

1. In a ceramic discharge vessel for a high-pressure discharge lamp, having an inner volume which contains a light-emitting filling, and having a longitudinal axis as well as two ends with openings; electrical leads fitted in a gas-tight manner into the openings, which leads are connected electrically with two electrodes each having an end extending into said volume at opposite ends thereof and defining a distance therebetween, the improvement comprising:, the contour of the inner wall having an essentially straight cylindrical central part of length L and inner radius R as well as two essentially hemispherical end pieces with the same radius R, said length of said cylindrical central part being smaller than or equal to its inner radius; the inner length of the discharge vessel given by 2R+L being at least 10% greater than a distance EA between said electrodes; and the diameter (2R) of the discharge vessel corresponding to at least 80% of said defined distance EA and at most about 150% of said defined distance.

2. The ceramic discharge vessel according to claim 1, wherein the wall load of the discharge vessel lies between 25 and 45 W/cm$^2$.

3. The ceramic discharge vessel according to claim 1, wherein the wall load of the discharge vessel (in W/cm$^2$) is selected dependent on rated power P (in W) of the discharge vessel, such that:

$$25 \leqq P/(4\pi R^2+2\pi RL) \leqq 35.$$

4. Ceramic discharge vessel according to claim 1, wherein the inner volume V of the discharge vessel amounts to at least 100 $\mu$l, the rated wattage being at least 35 W.

5. Ceramic discharge vessel according to claim 1, wherein the inner volume of the discharge vessel (in $\mu$L) is selected dependent on the rated power P (in W) according to the following formula: $0.16 \bullet P^{5/3} \leqq V \leqq 0.32 \bullet P^{5/3}$, preferably $$0.22 \bullet P^{5/3} \leqq V \leqq 0.32 \bullet P^{5/3}.$$

6. Ceramic discharge vessel according to claim 1, wherein L≦0.5 R.

7. Ceramic discharge vessel according to claim 6, wherein the inner contour is described by a rotation ellipsoid with the semi-axes a and b, whereby $$R \leqq a \leqq 1.1\ R \text{ and } b=R+L/2.$$

8. Ceramic discharge vessel according to claim 1, wherein the wall thickness of the discharge vessel amounts to between 5 and 15% of the inner radius R at least in the center of the discharge vessel.

9. Ceramic discharge vessel according to claim 1, wherein the wall thickness increases toward the ends and there amounts to up to double the wall thickness in the center.

10. Ceramic discharge vessel according to claim 1, wherein plugs are introduced into the openings, and these plugs are arched concavely on the front sides, on the side of the discharge.

* * * * *